United States Patent [19]

Szonnell

[11] Patent Number: 4,498,806

[45] Date of Patent: Feb. 12, 1985

[54] BEACH EROSION PREVENTION JETTY CONFIGURATION

[76] Inventor: Henry H. Szonnell, 2401 Georgetown Rd., Bradenton, Fla. 33507

[21] Appl. No.: 513,061

[22] Filed: Jul. 12, 1983

[51] Int. Cl.[3] ..... E02B 3/08

[52] U.S. Cl. ..... 405/34; 405/15; 405/52; 405/16

[58] Field of Search ..... 405/34, 35, 32, 52, 405/80, 15, 16, 31, 30; 14/75

[56] References Cited

U.S. PATENT DOCUMENTS

| | | | |
|---|---|---|---|
| 630,457 | 8/1899 | Hogeland | 405/84 |
| 1,575,362 | 3/1926 | Haupt | 405/34 |
| 2,044,795 | 6/1936 | Knight | 405/52 |
| 3,667,234 | 6/1972 | De Lizasoain | 405/80 |
| 4,023,369 | 5/1977 | Wirasinha | 405/52 |

FOREIGN PATENT DOCUMENTS

| | | | |
|---|---|---|---|
| 851774 | 10/1952 | Fed. Rep. of Germany | 405/52 |
| 779499 | 11/1980 | U.S.S.R. | 405/80 |

*Primary Examiner*—Dennis L. Taylor

*Attorney, Agent, or Firm*—Sherman Levy

[57] ABSTRACT

A beach erosion jetty configuration is provided wherein the jetties are curved to stop or prevent a vacuum effect which causes beach erosion. Swift currents running in or out of inlets create a Venturi effect that pulls sand-laden waters from nearby and sometimes distant shorelines, and in accordance with the present invention jetties are provided with curved ends that negate the loss of precious sand. Such curved jetties function as erosion control devices and actually stop and prevent erosion.

9 Claims, 2 Drawing Figures

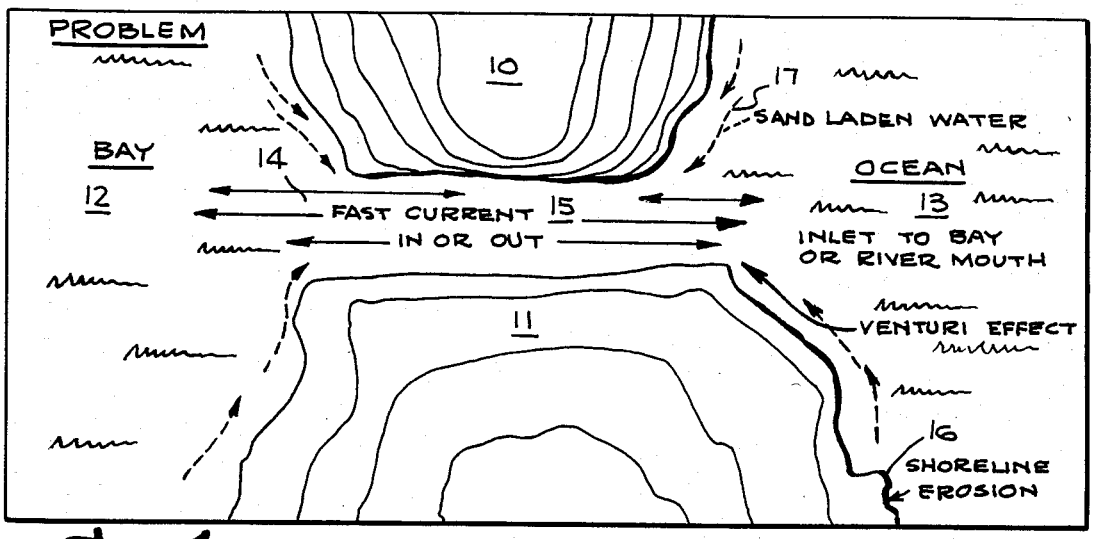
Fig-1
Fig-2
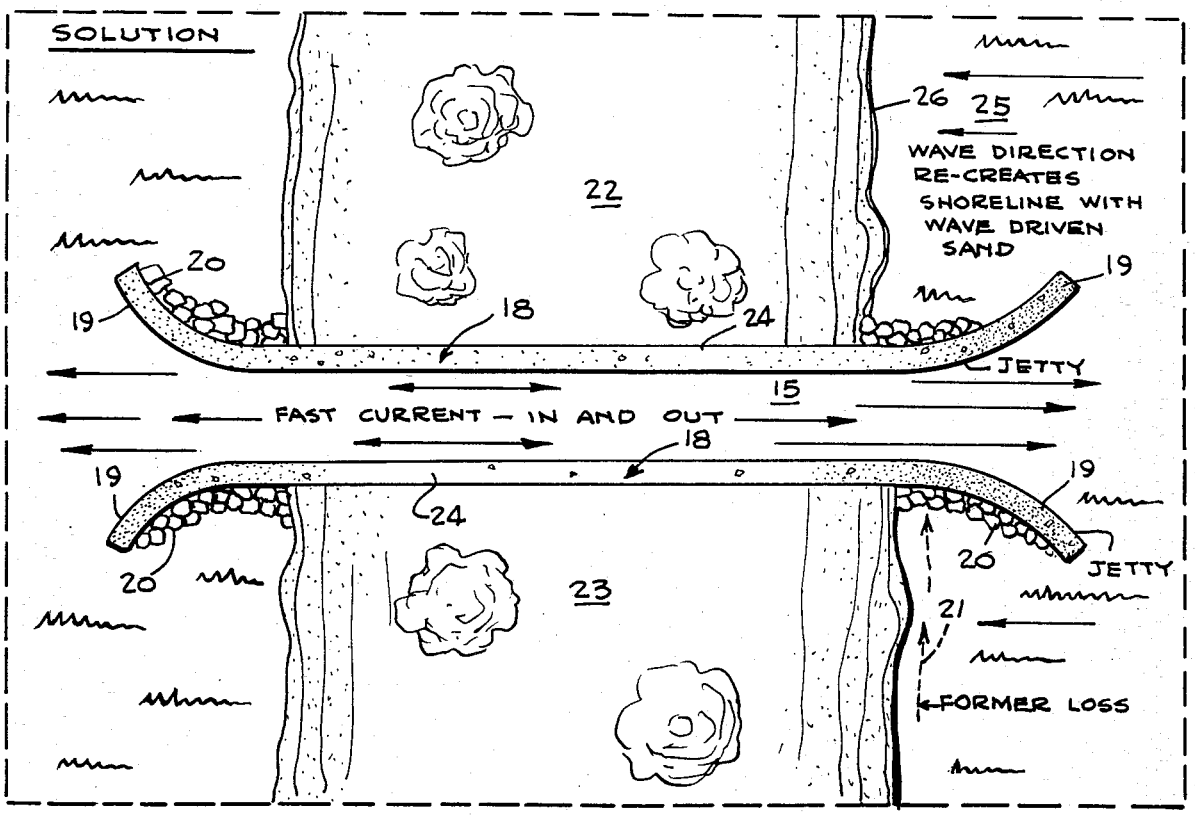

BEACH EROSION PREVENTION JETTY CONFIGURATION

FIELD OF THE INVENTION

The present invention relates to beach erosion prevention, and more particularly, to jetties which have curved portions that prevent vacuum action from causing beach erosion. Curved jetties are provided that serve as erosion control means and wherein the jetties negate the Venturi effect in order to prevent erosion.

DESCRIPTION OF THE PRIOR ART

As is known, there have been various types of erosion control means previously provided or attempted such as those shown in prior patents: U.S. Pat. Nos. 1,168,547; 1,428,808; 1,833,154; 2,162,499; 2,745,768; 3,750,408; 4,279,535; 4,288,175; 4,312,601; 4,353,946; and 4,367,984. However, neither these prior patents nor any others known to applicant afford the advantages and features provided by the invention of the present application.

BACKGROUND AND SUMMARY OF THE INVENTION

In accordance with the present invention, curved jetties are provided to negate the Venturi effect so as to prevent erosion. With the present invention straight jetties are provided with angling or curved ends. Waters rushing out to sea tend to remain in the direction they were travelling in the inlet or when they leave an island end. A Venturi effect is created when the tides push the current through a narrowed inlet and make the water less dense. This is a hydraulic version of a vacuum and it is this phenomenon that draws sand-laden waters into it from nearby and sometimes distant shores. The curved or angled end negates this and the coastwise current in the swash channel ceases to move towards the inlet. Subsequently every wave pushes sand toward the shore and nature again begins to build the island in the same manner that was done when the barrier reefs were an unbroken chain.

With the present invention the curved jetty creates a naturally sloped beach which is a safe beach so that there are a number of advantages provided. For example, safe swimming is assured near the mouths of rivers and the like. The Venturi effect is negated as, for example, it is ordinarily created when tides run swiftly in or out at the inlets or ends of the causeway. The present invention will eliminate the need for most of the so-called erosion control devices along the shore-line and most of the vegetation such as sea oats and dunes, and there are other advantages and important features of the present invention as subsequently noted in this patent application.

For a better understanding of the present invention together with other and further objects thereof, reference is made to the following description taken in connection with the accompanying drawing and its scope will be pointed out in the appended claims.

BRIEF DESCRIPTION OF THE DRAWINGS

FIG. 1 is a view illustrating schematically the problem addressed by the present invention.

FIG. 2 is a schematic view illustrating the solution to the problem with the present invention.

DESCRIPTION OF THE PREFERRED EMBODIMENT

Referring in detail to the drawings, the numerals 10 and 11 indicate the bodies of land or shorelines, and for purposes of illustration in FIG. 1, the numeral 12 indicates a bay area while the numeral 13 indicates an ocean area. It is to be understood that these designations of bays and oceans are merely for illustrative purposes and the principles of the present invention are applicable to various other types of bodies of water and the like. In FIG. 1, the numeral 14 indicates the current flow and the arrows show that the current flow 14 may be fast current in or out, as for example depending upon tides and the like. The numeral 15 indicates an inlet between the land masses 10 and 11. Also in FIG. 1, the numeral 16 indicates shoreline erosion, and the numeral 17 indicates sand-laden water moving in the direction of the arrows.

Attention is directed to FIG. 2 of the drawings wherein according to the present invention jetties 18 are provided, and in accordance with the present invention the ends of the jetties 18 are curved as at 19. Suitable reinforcements 20 may be provided adjacent to the curved ends of the jetties as shown in the drawings, but it is to be understood that such support portions or reinforcements 20 can be varied or changed or eliminated as desired or required. The jetties 18 may be made of any suitable material and in different shapes or sizes.

In FIG. 2 the numeral 21 indicates diagramatically the former loss occasioned by shoreline erosion, and the numerals 22 and 23 in FIG. 2 show the land masses stabilized after the positioning of the jetties 18 with the curved ends 19.

From the foregoing, it will be seen that there has been provided a method and means for preventing beach erosion, using a jetty configuration.

It is desired to point out that swift currents in passes between land masses can pull unsuspecting bathers into them from nearby as well as distant beaches. It is the same phenomenon that is the unrecognized character in beach erosion, and it pulls the sand-laden waters into it also. All that is needed to prevent beach erosion and create safe sloping beaches is to install curved jetties at the pass or inlet, as shown and described in the present invention. Swimmers near the inlets are in danger at the time the tides are running swiftly. Generally, two curved jetty installations such as the jetties 18 with the curved ends 19 will stabilize the inlets such as the inlet 15 and prevent erosion on both sides 22 and 23 of the inlet, as well as benefiting adjacent shorelines for quite a distance. The jetties 18 may be elongated and may be in the configuration of angling jetties constructed of any suitable materials such as field rock and marl and by using such jetties 18 with curved ends 19, a tremendous amount of beach will be built in front of sand keys and the like so as to create beach fronts in front of condominiums or any other area or structures, before a dredging operation is begun.

Heretofore, many areas have been eroded and people have had their properties eroded including expensive homes and various methods of preventing erosion have been attempted, such as by using sand bags. Curved jetties made in accordance with the present invention are the ultimate in erosion control methods because they negate the Venturi effect that is created in the passes when tides run swiftly in or out. It is similar to a vacuum and it draws the precious sand and sometimes unwary swimmers into the inlet to be carried either out to sea or into the bay.

There has been a constant struggle by mankind to prevent the bay's natural ebb and flow from chewing away at the coastline, and two curved jetties such as the jetties 18 will stabilize an inlet such as the inlet 15, and prevent erosion on both sides of the inlet 15 and thus recreate safe, sloping shores for quite a distance.

The parts can be made of any suitable material in different shapes or sizes as desired or required.

As is known, beach front dwellers have often actually watched wide white stretches of sand or shoreline in front of them dwindle and narrow. Thus, swift moving water in inlets rushing out to the ocean tosses debris with it and the Venturi effect has caused much erosion. In accordance with the Venturi effect, matter moving swiftly is less dense and therefore attractive to slow-moving matter nearby. Tidal water forced into a narrow and deep inlet moves rapidly and in accordance with the present invention, as the water rushes out of the inlet, it draws sand-laden water from adjacent beaches to it and pulls it out to sea, and wherever narrow channels had been created, where tides are swift, severe erosion near them has developed.

In accordance with the present invention there is provided a way for stopping the channel water from taking a lot of other water with it, and there is provided an artificial shoal which may be curved toward the beach and the present invention will cost no more than the groins and jetties that have been built all along, destroyed and built again. The present invention is characterized by its simplicity. Thus, the shoal will be a barrier between the swift water and the slower water so the slow water cannot be attracted to it. If it curves in towards the shore it will hold the water like a cupped hand, keeping the sand it bears near the shore where it belongs.

Thus, swash channels which are deep places between the beach and a sand bar further out demonstrate this principle. It is believed that the swash channels are dug by the lateral motion of water cutting sand rushing towards fast-moving tide surges.

It is believed that the Venturi effect is responsible for such erosion. According to the present invention, fast flowing tides rushing in and out of the bay side of an island, for example, are freely drawing sand and water from adjacent areas as they pass, and by utilizing curving shoals for jetties, as for example between residences and the tidal flow, beaches will start rebuilding.

Further, drowning of swimmers is believed to be the result of the Venturi effect which is created by water moving rapidly through passes or inlets and pulling swimmers into the pass. By utilizing a curving shoal at the end of the beach, this problem will be eliminated. The present invention works with nature rather than fighting with nature. With the present invention beaches will not need to be re-nourished.

The present invention is very simple and consists of the jetties 18 having the angling or curved ends to the straight portions 24 of the jetties 18. A straight jetty is sometimes considered to be the state of the art engineering. Waters rushing out to sea tend to remain in the direction they were traveling in the inlet, or when they leave an island end. A Venturi effect is created when the tides push the current through a narrowed inlet and make the water less dense. This is a hydraulic version of a vacuum and it is this phenomenon that draws sand-laden waters into it from both nearby and sometimes distant shores. The curved angled ends 19 negate this, and the coast-wise current in the swash channel ceases to move towards the inlet. Then, every wave pushes sand toward the shore and nature again begins to build the island in the same manner that was utilized when barrier reefs were an unbroken chain.

It is to be noted that the curved jetties with the curved-in portions 19 stop the sand from being transported into the inlet, via the swash channel, and the waves deposit sand on the beach permanently. Beaches are created by wave-driven sand from all directions. In FIG. 2, the numeral 21 indicates schematically the former loss of beach or sand.

There have been various theories advanced previously as to why many lives have been lost by currents and some say riptides are responsible for the victims. Others say the undertow seized the unwary swimmer. But most of the time it is the Venturi effect which has snatched another unfortunate person and pulled him into fast currents in the inlet or the swift water at the island or causeway end. It is believed that most bathers die because of the exhaustion and fright, and that no water would be found in their lungs. Thus, persons under such circumstances who have died, died because the suspected death was due to exhaustion. By installing curved jetties where creeks run into rivers, lakes or oceans, many lives would be saved because the unsuspected currents would cease to be. The aforementioned phenomenon is also the causative factor in beach erosion and serves a dual service by saving lives and sand.

In accordance with the present invention the curved jetty negates the cause of beach erosion which is the hydraulic version of the phenomenon that operated instruments in older aircraft. A Venturi tube in the slip stream produced a vacuum, and the tubing connected it to the instruments. Swift currents running in or out of the inlets create the Venturi effect that pulls sand-laden waters from nearby and sometimes distant shorelines, and a jetty with a curved or angling-seaward end will negate the loss of precious sand only if it angles away from the pass or island end. Curved jetties that angle out into the inlets exist but cannot work and only magnify the force that causes erosion. The curved jetty is the ultimate erosion control device because it actually stops and thereby prevents erosion. With the present invention there is provided coastal erosion containment methods and means. The jetties 18 may be chinked with aggregate 20 which may be of a suitable size. A curved or angled jetty negates the Venturi effect created by swift waters in narrowed inlets or channels at the island or causeway ends.

The present invention will actually prevent beach erosion because it deals with the causative factors. Beaches are not lost to the lakes, seas or ocean, but the sand-laden currents are drawn coast-wise to inlets, or mouths of rivers that at times can be quite distant from the areas which are being eroded by a Venturi effect created when waters run swiftly in or out at the inlets or island ends. This Venturi effect can be negated by curved or angled seaward ends added on to state of the art straight jetties. Straight jetties which may be lengthy, will pull sand-laden waters from both nearby and distant beaches. Some jetties were called curved jetties but they actually angled out into the passes and because of this accelerated beach erosion on the adjacent shoreline.

Thus, tidal flow through an inlet mimics airflow through a Venturi tube, and according to the Venturi effect the speed of either air or water entering a constricted channel increases with increasing constriction, while the pressure decreases, thus creating a scouring action which coastal engineers exploit to keep the pass clear of sand and sediment. As an example, so efficient is the effect that frequently a jettied inlet will pull sand from the beach, causing erosion and creating a need for continuing dredging and beach nourishment. With the present invention, there is provided a simple solution to the problem which consists of building short, curved jetties at the squared-off ends of dredged inlets, which the vacuum effect drawing sand from adjoining beaches being arrested, so as to produce an inlet which not only would require less navigational maintenance, but would build rather than destroy the adjacent beaches.

As shown in FIG. 2, the numeral 25 indicates wave direction recreating the shoreline 26 with wave-driven sand.

There have been instances where builders have constructed condominiums which narrowed an inlet, creating a Venturi effect which sucked sand from further up the beach and was dumped into the pass adjacent to construction. In the past jetties built with flaring or curved configurations have built beaches behind their recurved form and will continue to do so if left undisturbed.

The term tidal prism is sometimes used and is defined as a volume of water in an inlet which if compressed too greatly will encourage scouring and if not compressed frequently will induce filling. The present invention provides a permanent remedy to inlet erosion, and curved jetties are the solution. Such curved jetties work in conjunction with nature by preventing the Venturi effect or hydraulic action that automatically occurs when currents or tides run in and out of narrow channels as they enter or leave the ocean, a bay or gulf, sucking sand from nearby and even distant beaches. This natural phenomenon can be seen near bridges, causeways, and at the ends of islands. The curving jetties stop the coast-wise currents and cause every wave to bring sand in towards the shore where it is deposited and stays as long as the jetty is intact. The jetties can be made of any suitable length and size.

Heretofore, dredging operations have been used or attempted, but these merely returned the sediment to the beaches and swash channels from whence it came, but do not prevent it from leaving the beaches where it should stay. For larger installations, over-curved, massive jetties can be used to protect beaches, so as to prevent precious sand from being drawn away.

Furthermore, curved jetties create safe beaches.

The principles of the present invention are important because they work on the cause of beach erosion. The Venturi effect pulls the sand from precious shores, and swash channels are created by the currents heading for inlets.

In conclusion, the present invention possesses certain important advantages and features. Heretofore, a number of jetties have been built which angle the wrong way. For example, water does not fan out when swift currents enter the gulf or ocean, contrary to belief.

With the curved jetty of the present invention, there will be created a naturally sloping beach which is safe and which will make swimming safer near river mouths and the like. The Venturi effect will be negated, which is the effect that is created when tides run swiftly in or out at the inlets or causeway ends. Further, with the present invention, there will be eliminated the need for most of the so-called erosion control devices along the shoreline and most of the vegetation such as sea oats and dunes that are only piecemeal efforts.

As is well-known, winter storms and the like ravage beaches, topple homes into the sea and change the contours of long stretches of sandy shorelines. Heretofore, pilings have been utilized or tried and marine scientists have often felt that the relentless ocean wages a never-ending war with the shoreline, winning almost every battle as coastal beaches are continually eroded. Due to the dynamics of coastal erosion, some beaches disappear completely while others are substantially built up and one theory was that erosion began on the bottom of the ocean hundreds of years offshore and at considerable depth.

Various campaigns have been undertaken by oceanographers and marine geologists to learn more about the dynamics of the ocean as well as its currents, tides, waves and energies and how people can better cope with the awesome impact of the sea on the land for the aforementioned reasons. Sometimes the loss of coastline has been dramatic, as for example after storms or hurricanes. Some of the previous attempts have tried to utilize jetties, piers, beach nourishment with dredged sand, old tires, brick walls, hulks of abandoned ships, sand bags, artifical seaweed and the like, but shore erosion has continued. In other areas slope facings of heavy rock have been tried. With the present invention a simple solution is provided for these problems.

Thus, the curved jetty will negate the Venturi effect as previously described.

While several embodiments of the present invention have been illustrated herein in particular detail, it will be understood that variations and modifications may be effected without departing from the spirit and scope of the novel concepts of this invention.

What is claimed:

1. 1 In a beach erosion prevention jetty configuration for use with spaced apart shorelines having an inlet therebetween, jetties contiguous to said shoreline and said jetties being arranged on opposite sides of said inlet, said inlet permitting water current of different velocity and tides to flow between bays, oceans, and the like, each of said jetties having straight sections and curved, angling end portions.

2. The structure as defined in claim 1 wherein each jetty includes a major straight section.

3. The structure as defined in claim 2 wherein the direction of waves recreate the shoreline with wave driven sand.

4. The structure as defined in claim 3 wherein the curved jetties create a naturally sloping, safe beach and wherein the curved jetties negate the causative Venturi effect that is created when tides run swiftly in or out at the inlet or ends of causeway.

5. The structure as defined in claim 4 wherein the jetties have the curved, angling ends which negate the hydraulic version of vacuum whereby nature can build land masses and shorelines so that the curved jetties stop sand from being transported to the inlet via swash channels, and the waves deposit sand on the beach permanently so that beaches are recreated by wave driven sand from all directions, the seaward end of the jetties angling approximately 45 degrees away from the inlet or river mouth.

6. The structure as defined in claim 5 wherein the jetties with curved end portions that extend seaward will negate the loss of precious sand by flowing away from the end of a land mass, said curved jetties functioning as an erosion control means by actually stopping and preventing erosion.

7. The structure as defined in claim 6 and further including reinforcements disposed outwardly and adjacent to the curved end portions of the jetties.

8. A method of preventing beach erosion comprising the steps of providing jetties adjacent to sides of an inlet, providing said jetties with straight sections and curved end portions, and wherein the jetties with the curved end portions negate the Venturi effect from currents of water travelling through an inlet and the like, the jetties having a seaward end that is angled away from the inlet or island end, and wherein the jetties with the curved end portions eliminate the need for most of the various erosion control means that are sometimes used along shorelines as well as eliminating the need for vegetation being used as erosion control means, the angling exit of the jetties being approximately 45 degrees.

9. The method as defined in claim 8 wherein the curved end portions of the jetties define artificial shoals curved towards the beach so as to permit beaches to rebuilt by forces of nature, the angled ends of the jetties pointing away from the inlet.

* * * * *